US008910931B2

(12) United States Patent
Iwata

(10) Patent No.: US 8,910,931 B2
(45) Date of Patent: Dec. 16, 2014

(54) SHEET FEEDING DEVICE

(71) Applicant: Naoyuki Iwata, Nagoya (JP)

(72) Inventor: Naoyuki Iwata, Nagoya (JP)

(73) Assignee: Brother Kogyo Kabushiki Kaisha, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 14/040,229

(22) Filed: Sep. 27, 2013

(65) Prior Publication Data

US 2014/0103600 A1 Apr. 17, 2014

(30) Foreign Application Priority Data

Oct. 11, 2012 (JP) ..... 2012-225751

(51) Int. Cl.
*B65H 3/06* (2006.01)

(52) U.S. Cl.
CPC ..... *B65H 3/06* (2013.01)
USPC ..... 271/117; 271/121

(58) Field of Classification Search
CPC ..... B65H 3/06; B65H 3/0607; B65H 3/0676; B65H 3/0684; B65H 3/32; B65H 3/52; B65H 3/5223; B65H 3/56
USPC ..... 271/121, 117, 118
See application file for complete search history.

(56) References Cited

U.S. PATENT DOCUMENTS

| | | | | |
|---|---|---|---|---|
| 5,441,250 | A | 8/1995 | Kameyama et al. | |
| 5,882,004 | A * | 3/1999 | Padget | 271/119 |
| 8,047,533 | B2 * | 11/2011 | Kuo | 271/121 |
| 8,052,139 | B1 * | 11/2011 | Su et al. | 271/117 |
| 8,231,122 | B2 * | 7/2012 | Tu | 271/121 |
| 8,474,813 | B2 * | 7/2013 | Cheng et al. | 271/121 |
| 2002/0096819 | A1 * | 7/2002 | Fukasawa et al. | 271/121 |
| 2003/0201595 | A1 * | 10/2003 | Chiang et al. | 271/121 |
| 2004/0188918 | A1 * | 9/2004 | Morimoto et al. | 271/121 |
| 2005/0263955 | A1 * | 12/2005 | Kim | 271/121 |
| 2006/0038339 | A1 * | 2/2006 | Shimamura | 271/121 |
| 2011/0156340 | A1 | 6/2011 | Otsuki | |

FOREIGN PATENT DOCUMENTS

| | | | |
|---|---|---|---|
| JP | H02-123045 | A | 5/1990 |
| JP | 2011-136793 | A | 7/2011 |

* cited by examiner

*Primary Examiner* — David H Bollinger
(74) *Attorney, Agent, or Firm* — Merchant & Gould PC

(57) ABSTRACT

A sheet feeding device including: a sheet feeding roller configured to convey a sheet; a placing portion on which the sheet is configured to be placed; a moving unit configured to move the placing portion toward the sheet feeding roller; a separation pad to which a leading end of the conveyed sheet is configured to abut at a contact position; a separation roller configured to nip the sheet conveyed by the sheet feeding roller between the separation pad and the separation roller at a nip position while bringing the sheet into sliding contact with the separation pad; and a separation assistant member provided between the sheet feeding roller and the separation roller and configured to change a distance between the nip position and the contact position according to a basis weight of the sheet by coming into contact with the sheet.

20 Claims, 6 Drawing Sheets

SHEET FEEDING DEVICE

CROSS-REFERENCE TO RELATED APPLICATIONS

This application claims priority from Japanese Patent Application No. 2012-225751 filed on Oct. 11, 2012, the entire contents of which are incorporated herein by reference.

TECHNICAL FIELD

Aspects of the present invention relate to a sheet feeding device.

BACKGROUND

A sheet feeding device disclosed in related-art includes a sheet feeding tray, a sheet feeding roller, a moving unit, and a separation roller. The sheet feeding tray has a placing portion on which sheets are placed. The sheet feeding roller is disposed at a position facing the placing portion. The sheet feeding roller comes into contact with the sheet placed on the placing portion to convey the sheet. The moving unit moves the sheet placed on the placing portion toward the sheet feeding roller. The separation roller is disposed at a downstream side than the sheet feeding roller in a sheet conveying direction. The separation roller conveys the sheet conveyed by the sheet feeding roller in a state in which the sheet is nipped between the separation roller and the sheet feeding roller while being brought into sliding contact with a separation pad.

According to the related-art sheet feeding device, in a case where a plurality of sheets are placed on the placing portion of the sheet feeding tray, the sheets are moved toward the sheet feeding roller by the moving unit, and the uppermost sheet on the placing portion is brought into contact with the sheet feeding roller. In this way, one sheet or a plurality of sheets are conveyed toward the downstream side in the sheet conveying direction by the sheet feeding roller. Then, the one sheet or plurality of sheets are nipped between the separation roller and the separation pad, and are conveyed further to the downstream side, for example, an image forming unit. In this instance, a sheet conveying resistance is applied to each sheet due to the sliding contact with the separation pad. This causes the plurality of sheets to be separated one by one.

SUMMARY

However, even when the sheet feeding device includes the separation pad and the separation roller, like the sheet feeding device of the related art, the sheet is sometimes double fed or non-fed. The inventor of the present application thinks the reason thereto as follows.

That is, in a case where a plurality sheets are placed on the placing portion of the sheet feeding tray, if a conveying force of the sheet feeding roller is too strong, the sheets are double fed. On the other hand, if the conveying force of the sheet feeding roller is too weak, the sheet is non-fed. The conveying force of the sheet feeding roller is determined by a material of the sheet feeding roller, a pressing force of the sheet feeding roller against the sheet, a rotation amount of the sheet feeding roller, or the like.

Meanwhile, the sheet has various basis weights ($g/m^2$) according to its kind. Although a proportional relationship is not always established, the sheet having the low basis weight is weak in stiffness, while the sheet having the high basis weight is strong in stiffness.

For this reason, in the sheet feeding device described above, if the conveying force of the sheet feeding roller is set so that it is difficult for the non-feeding to occur for the sheet with the strong stiffness, the double feeding easily occurs for the sheet with the weak stiffness. By contrast, if the conveying force of the sheet feeding roller is set so that it is difficult for the double feeding to occur for the sheet with the weak stiffness, the non-feeding easily occurs for the sheet with the strong stiffness.

In the above-described sheet feeding device, the sheet is slightly bent from the sheet feeding roller to the separation pad or the separation roller, and thus a conveying resistance corresponding to its stiffness is generated to the sheet due to the bending.

In the above-described sheet feeding device, if the conveying force of the sheet feeding roller is set so as not to perform non-feeding or double feeding of a sheet having the basis weight of a predetermined range, since it is possible to obtain the favorable conveying force only within the predetermined range of the basis weight, the degree of freedom to select the sheet is limited.

In view of the above, the present invention provides a sheet feeding device capable of suppressing occurrence of double feeding or non-feeding.

According to an aspect of the present invention, there is provided a sheet feeding device including: a sheet feeding roller configured to come into contact with a sheet and convey the sheet; a placing portion configured to swing toward the sheet feeding roller and on which the sheet is configured to be placed; a moving unit configured to move the placing portion toward the sheet feeding roller; a separation pad to which a leading end of the sheet conveyed by the sheet feeding roller is configured to abut at a contact position; a separation roller disposed at a downstream side than the sheet feeding roller in a sheet conveying direction and configured to nip the sheet conveyed by the sheet feeding roller between the separation pad and the separation roller at a nip position while bringing the sheet into sliding contact with the separation pad; and a separation assistant member provided between the sheet feeding roller and the separation roller and configured to change a distance between the nip position and the contact position according to a basis weight of the sheet conveyed by the sheet feeding roller by coming into contact with the sheet.

According to another aspect of the present invention, there is provided A sheet feeding device including: a sheet feeding roller configured to come into contact with a sheet and convey the sheet; a placing portion configured to swing toward the sheet feeding roller and on which the sheet is configured to be placed; a moving unit configured to move the placing portion toward the sheet feeding roller; a separation pad to which a leading end of the sheet conveyed by the sheet feeding roller is configured to abut at a contact position; a separation roller disposed at a downstream side than the sheet feeding roller in a sheet conveying direction and configured to nip the sheet conveyed by the sheet feeding roller between the separation pad and the separation roller at a nip position while bringing the sheet into sliding contact with the separation pad; and a separation assistant member provided between the sheet feeding roller and the separation roller and configured to be swung or elastically deformed toward the separation roller by coming into contact with the sheet conveyed by the sheet feeding roller.

According to the above-described aspects, it is difficult for the double feeding or the non-feeding to occur, irrespective of the kind of sheet.

DETAILED DESCRIPTION

Hereinafter, first and second embodiments exemplifying the present invention will be described with reference to the accompanying drawings.

First Embodiment

Figure 1:
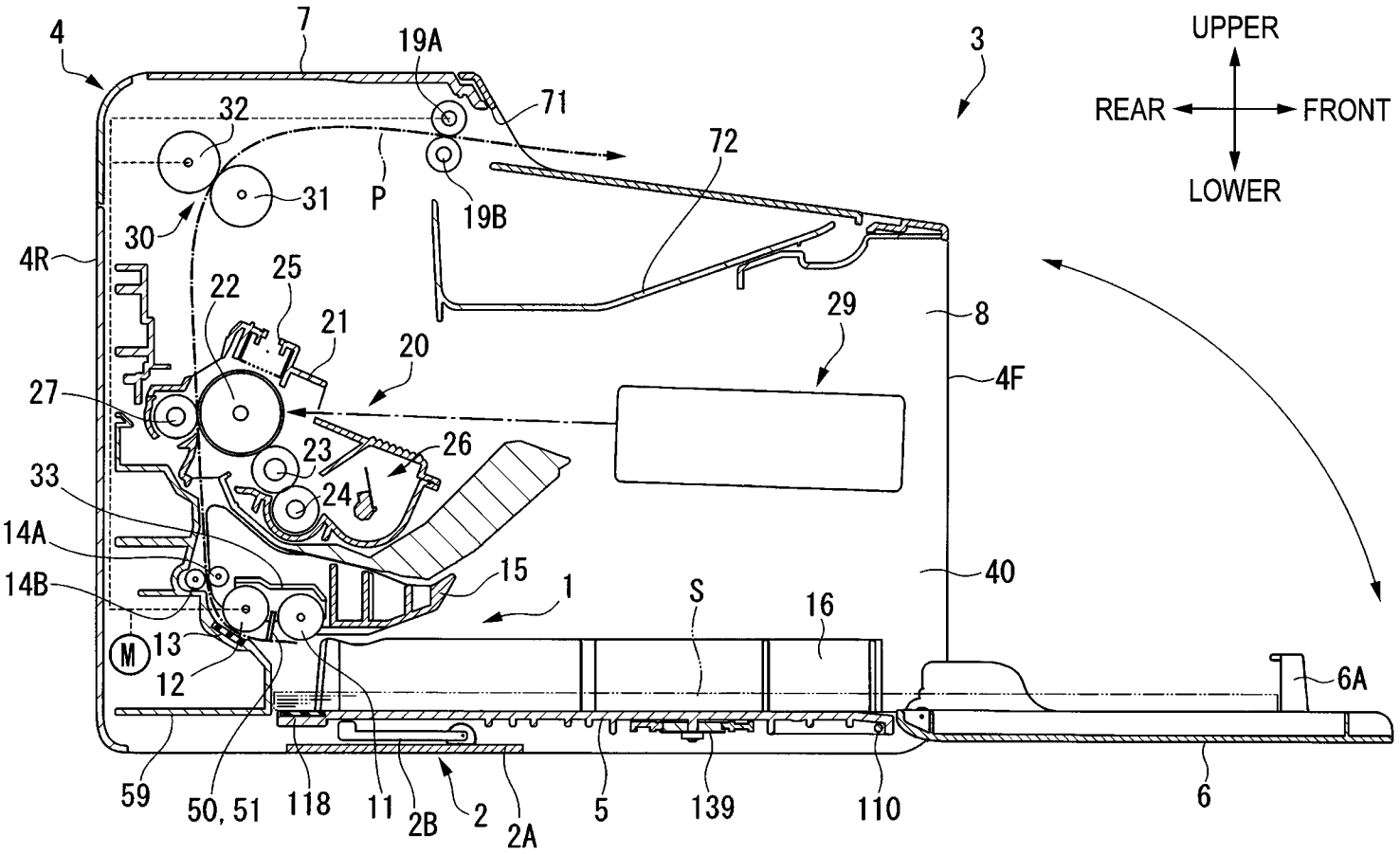
FIG. 1 is a cross-sectional view illustrating a printer according to a first embodiment of the present invention.

As illustrated in FIG. 1, a printer 3 of the first embodiment employs a sheet feeding device 1. The printer 3 is a monochrome laser printer 3, and includes a main body 4. The sheet feeding device 1 is disposed at a lower side in the main body 4. Each constitute element of the printer 3 will now be described with reference to the respective drawings. A forward/rearward direction, an upward/downward direction, and a left/right direction of the printer 3 are appropriately shown in the respective drawings.

Description of Printer

As illustrated in FIG. 1, the printer 3 includes the sheet feeding device 1 and an image forming unit 20 in the main body 4. Further, in the main body 4, the printer 3 includes an electric motor M as a power unit for a sheet feeding roller 11 or the like, and a control unit (not illustrated) for controlling various operations of the printer 3.

The main body 4 is provided with a conveying path P along which a sheet S is conveyed. The conveying path P has an upstream portion extending from a front portion to a rear portion of the main body 4 in the lower portion of the main body 4, a midstream portion being continuous to the upstream portion and extending from the lower portion to an upper portion of the main body 4, and a downstream portion being continuous to the midstream portion and extending from the rear portion to the front portion of the main body 4. The conveying path P is formed in a substantially C-shape. In FIG. 1, by a shape of the sheet S conveyed along the conveying path P, the shape of the conveying path P is concretely shown. Here, the sheet S is an object on which an image is formed by the printer 3, and includes an OHP sheet, in addition to paper sheet which is a paper medium.

The sheet feeding device 1 includes a sheet feeding roller 11, a separation roller 12, a separation pad 13, flaps 50 and 51, a sheet feeding frame 15, a platen 5, and a displacement mechanism 2. By the sheet feeding device 1, the sheet S is conveyed along the conveying path P in the printer 3.

The main body 4 is a substantially box-like body with a rear surface 4R being higher than a front surface 4F. The main body 4 includes a front cover 6, an upper cover 7, a transfer chute 59, and a frame member (not illustrated), in addition to a pair of left and right side frames 8 (only one side illustrated, and the same applied hereafter).

The pair of side frames 8 extends in the front/rear direction and the upper/lower direction along the left and right sides of the main body 4. The front surface 4F of the main body 4 is formed with an opening 40 at its lower side, and internal and external sides of the main body 4 are communicated with each other via the opening 40. The sheet S can be inserted into the main body 4 through the opening 40.

The front cover 6 is provided at the front surface 4F of the main body 4. The front cover 6 is rotatably supported by the main body 4 at its lower end side, and is able to swing with respect to the main body 4, as illustrated by the solid arrow in the drawing. In this way, the front cover 6 can be displaced between an open state to open the opening 40 toward the exterior of the main body 4 and a closed state to interrupt the opening 40 and the exterior of the main body 4. Further, a portion of the sheet S inserted in the main body 4 can be placed on the front cover 6 in the open state. The platen 5 corresponds to a placing portion of the present invention. The front cover 6 is provided with an end guide 6A for restricting the front/rear direction of the sheet S.

The upper cover 7 is disposed on the upper portion of the main body 4. The upper cover 7 is formed with a discharge port 71 for communicating the interior and the exterior of the main body 4 and a discharge tray 72.

The transfer chute 59 extends in the front/rear direction and the left/right direction along the rear surface 4R. A left end edge of the transfer chute 59 is engaged with the side frame, and a right end edge of the transfer chute 59 is engaged with the side frame 8. The separation pad 13 is provided at a lower portion the transfer chute 59. Also, the conveyance roller 14B is rotatably attached to the transfer chute 59 above the separation pad 13.

The sheet feeding frame 15 is engaged with the pair of side frames 8 at left and right end edges. In this way, the sheet feeding frame 15 is disposed at a position above and ahead of the transfer chute 59 in the main body 4. A conveyance roller 14A is rotatably attached to the sheet feeding frame 15 at a position facing the conveyance roller 14B.

Figure 2:
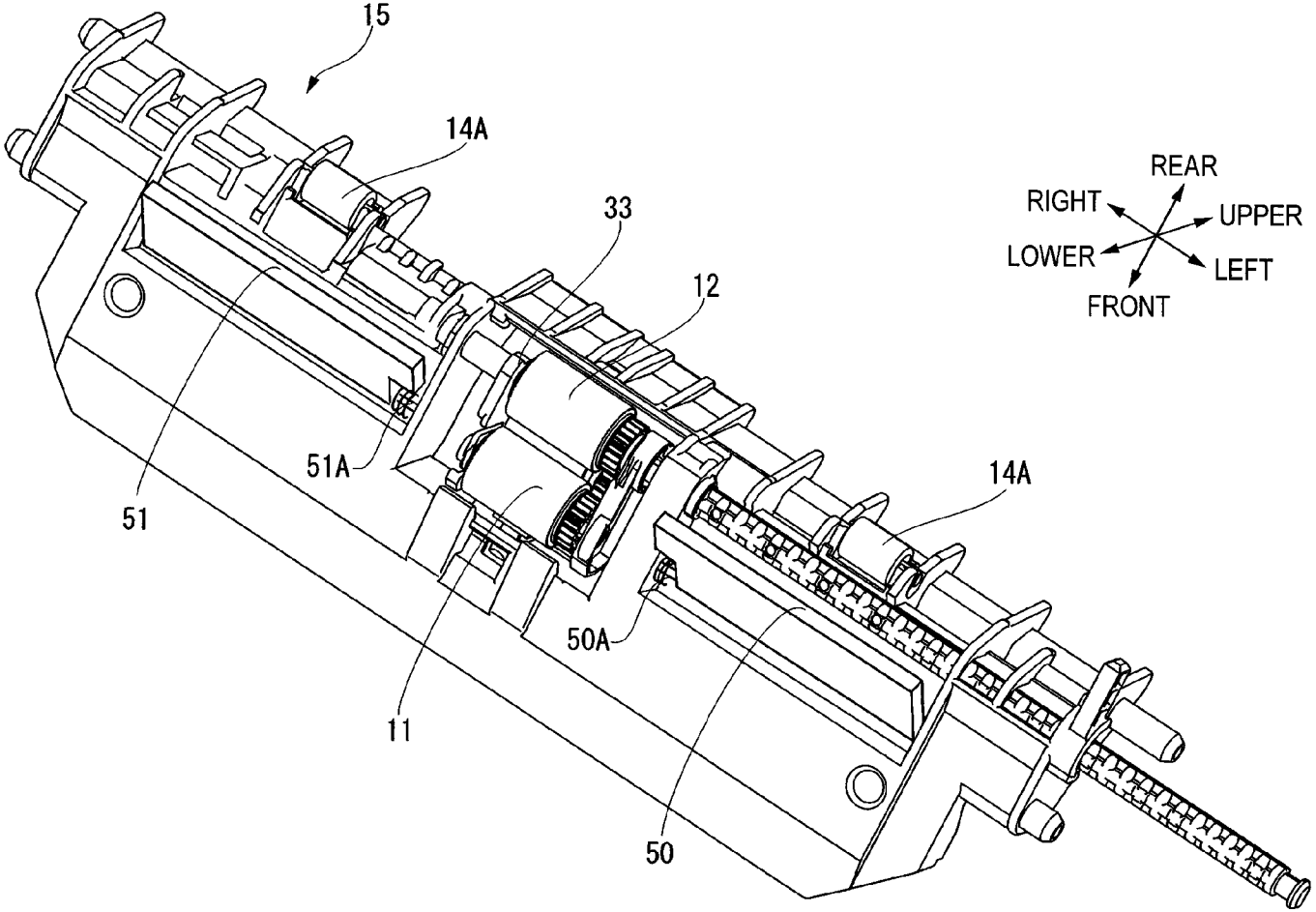
FIG. 2 is a perspective view illustrating major parts of the printer according to the first embodiment.

As illustrated in FIG. 2, the sheet feeding roller 11 and the separation roller 12 are held by one holder 33 which is able to swing with respect to the sheet S, and the holder 33 is held by the sheet feeding frame 15. The separation roller 12 is rotatable around a rotational shaft penetrating the sheet feeding frame 15 by power supplied from the main body 4 via the rotational shaft. The sheet feeding roller 11 is disposed at the upstream side than the separation roller 12 in the sheet conveying direction. When the sheet feeding roller 11 receives the power from the separation roller 12, the sheet feeding roller 11 rotates by following the separation roller 12.

Figure 3:
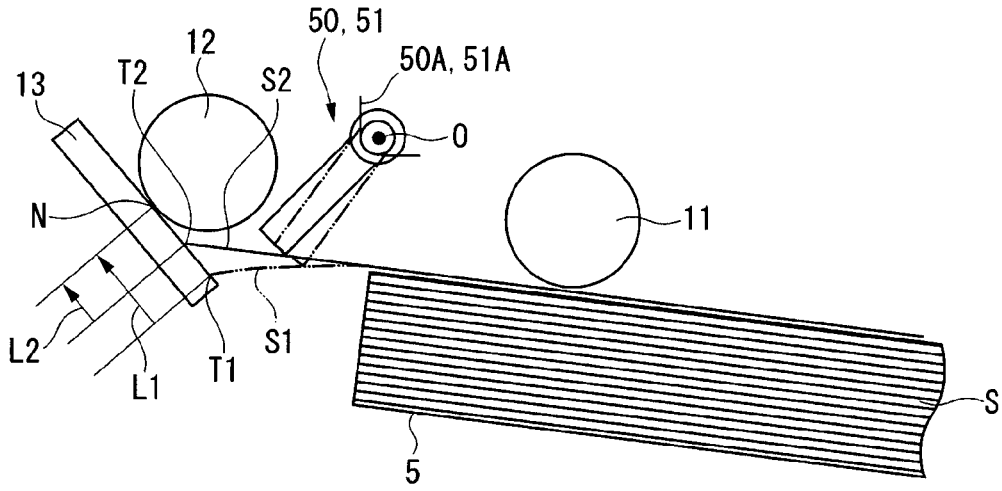
FIG. 3 is a schematic cross-sectional view illustrating the major parts of the printer according to the first embodiment.
Figure 4:
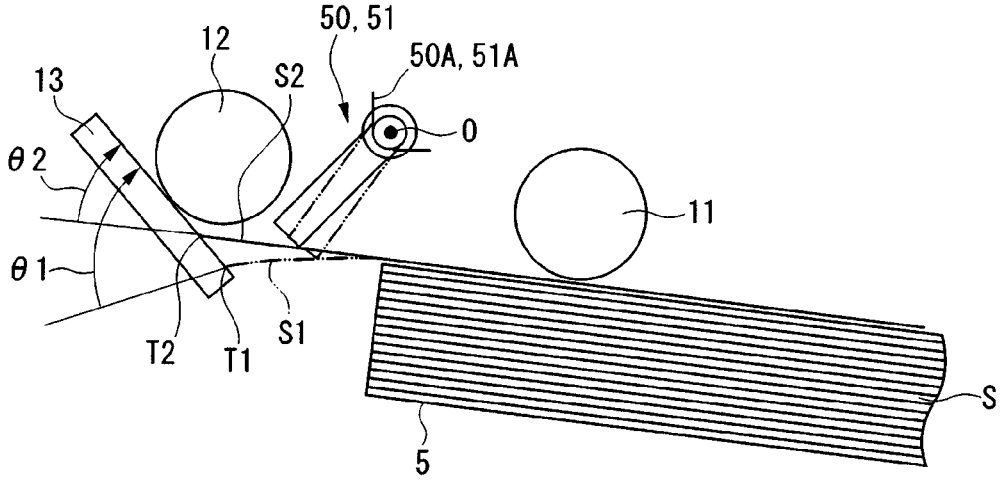
FIG. 4 is a schematic cross-sectional view illustrating the major parts of the printer according to the first embodiment.

The sheet feeding frame 15 is provided with the pair of flaps 50 and 51. These flaps 50 and 51 correspond to a separation assistant member of the present invention. The flaps 50 and 51 are provided between the sheet feeding roller 11 and the separation roller 12 in the sheet conveying direction, as illustrated in FIGS. 3 and 4, and are able to swing around a swing axis O which is arranged horizontally. If the flaps 50 and 51 are swung in the downward direction, the flaps come into contact with the sheet S conveyed by the sheet feeding roller 11 from the upward direction. Further, the flaps 50 and 51 have torsion coil springs 50A and 51A which can apply a preset biasing force thereto. The torsion coil springs 50A and 51A correspond to the biasing member. For this reason, if the flaps 50 and 51 are swung from the upward direction to the downward direction to come into contact with the sheet S, the sheet S presses the flaps 50 and 51 against the biasing force.

Figure 5:
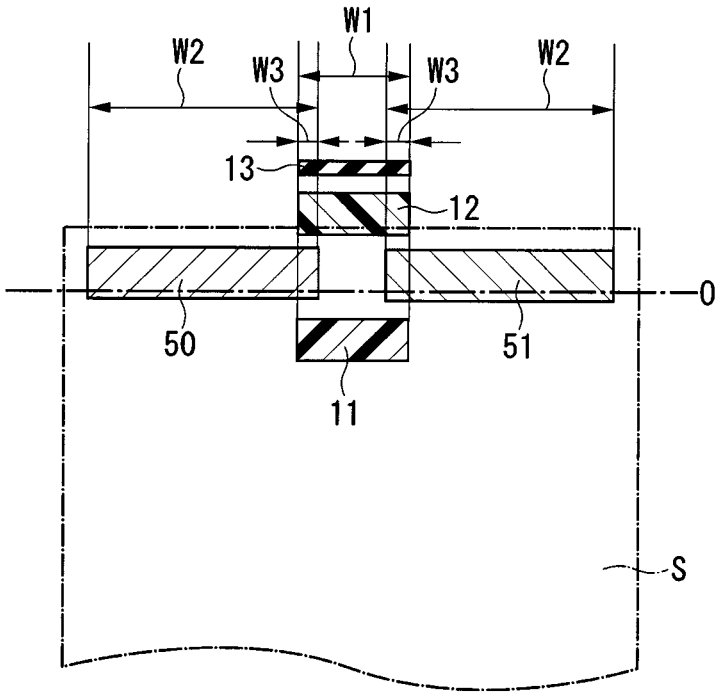
FIG. 5 is a schematic plan view illustrating the major parts of the printer according to the first embodiment.
Figure 6:
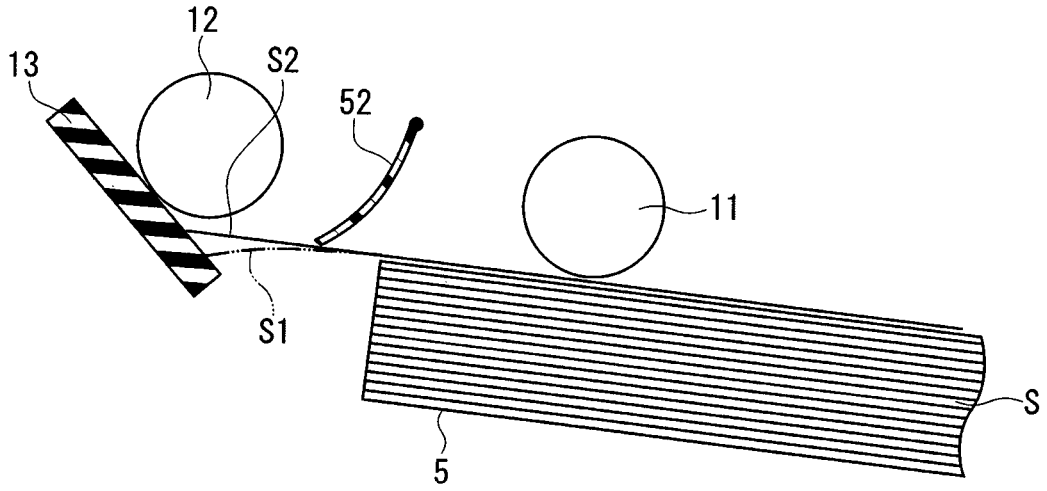
FIG. 6 is a schematic cross-sectional view of major parts of a printer according to a second embodiment of the present invention.

As illustrated in FIG. 5, the flap 50 is provided at one side of the separation roller 12 in a width direction of the sheet S, while the flap 51 is provided at the other side of the separation roller 12. The sheet feeding roller 11, the separation roller 12, and the separation pad 13 have a width W1 in the width direction of the sheet S. That is, the width of nipping the sheet S by the separation roller 12 and the separation pad 13 is W1. The flaps 50 and 51 have a width W2 larger than the width W1 in the width direction of the sheet S. Further, the flaps 50 and 51 are larger than the width W1 of the sheet feeding roller 11 in the width direction of the sheet S. In addition, the flaps 50 and 51 are provided at a position overlapped with the sheet feeding roller 11 by a width W3 in the sheet conveying direction.

As illustrated in FIG. 1, the platen 5 is disposed below the sheet feeding frame 15 in the main body 4, and faces the sheet feeding frame 15. The platen 5 is a substantially flat-plate member extending from the opening 40 to the vicinity of the transfer chute 59. The sheet S can be placed on the upper surface of the platen 5. More specifically, a portion of the sheet S inserted into the main body 4, which is not placed on the front cover 6, is placed on the upper surface of the platen 5.

A shaft 110 is provided at the front end side of the platen 5. The platen 5 is rotatably supported at each front end side of the both side frames 8 by the shaft 110. In this way, the rear end side of the platen 5 is able to be displaced between a separation position where the rear end side is separated downwardly from the sheet feeding roller 11 and the separation roller 12, and an adjacent position where the rear end side moves upward from the separation position to be adjacent to the sheet feeding roller 11 and the separation roller 12, around the shaft 110 (see FIGS. 3 and 4). As illustrated in FIG. 1, a frictional member 118 is attached to the rear end side of the platen 5.

The platen 5 is provided with a pair of left and right side guides 16 (only one side illustrated, and the same applied hereafter). The pair of side guides 16 is formed in a shape of partitions facing each other, and extends upwardly and vertically from the platen, and extends horizontally from the front end side of the platen 5 to the rear end side thereof in the substantially same length as the platen 5. The pair of side guides 16 is connected to each other by a rack and pinion mechanism 139 which is disposed on a lower surface of the platen 5. In this way, the pair of side guides 16 can be slid in the left/right direction on the platen, while being operated simultaneously with each other. Therefore, the pair of side guides 16 can perform the positioning of the sheet S placed on the platen 5 in the width direction.

The displacement mechanism 2 is provided to a bottom portion of the main body 4, and is positioned under the platen 5. The displacement mechanism 2 has a stationary plate 2A extending in the width direction of the main body 4, and a pushing-up plate 2B swingably disposed between the platen 5 and the stationary plate 2A. The pushing-up plate 2B is swung on the stationary plate 2A by the driving of the electric motor M to swing the plate 5 between the separation position and the adjacent position. The displacement mechanism 2 corresponds to the moving unit of the present invention.

The image forming unit 20 includes a process cartridge 21, a scanner 29, and a fixing unit 30.

The process cartridge 21 is positioned above the sheet feeding frame 15. The process cartridge 21 is a substantially box-like shape extending in the left/right directions of the main body 4, and the conveying path P is formed to pass through the process cartridge 21. The process cartridge 21 is provided therein with a photosensitive drum 22, a transfer roller 27, a developing roller 23, a toner supply roller 24, a toner accommodating portion 26, and a charger 25.

The photosensitive drum 22 is a cylindrical body extending in the left/right direction, and faces the sheet feeding path P from the front side. The transfer roller 27 faces to the photosensitive drum 22, with the conveying path P being sandwiched between the transfer drum 27 and the photosensitive drum 22. The photosensitive drum 22 and the transfer drum 27 are synchronously rotated, while nipping the sheet S conveyed along the conveying path P. The toner accommodating portion 26 accommodates toner to be supplied to the photosensitive drum 22. The toner supply roller 24 supplies the toner to the developing roller 23 from the toner accommodating portion 26, and the developing roller 23 develops an electrostatic latent image formed on the photosensitive drum 22. The charger 25 is extends parallel with the photosensitive drum 22 in the left/right direction, with the charger being spaced apart upwardly from the photosensitive drum 22. The charger 25 is positively charged by corona discharge.

The scanner 29 is positioned in front of the process cartridge 21. The scanner 29 includes a laser light source, a polygon miller, a fθ lens, and a reflecting mirror, and irradiates a laser beam toward the photosensitive drum 22 positioned at the rear side.

The fixing portion 30 is positioned above the process cartridge 21. The fixing portion 30 has a heating roller 31 facing the conveying path P from the front side, and a pressing roller 32 facing the heating roller 31, with the conveying path P being sandwiched between the heating roller 31 and the pressing roller 32.

The discharge rollers 19A and 19B are positioned at the lowermost downstream side of the conveying path P, and face the discharge port 71. The pair of discharge rollers 19A and 19B face each other, with the conveying path P being sandwiched therebetween.

Outline of Image Forming Process

The printer 3 forms an image on the sheet S supplied from the sheet supply device 1, as follows. The plurality of sheets S are placed on the platen 5 and the front cover 6, and if a control unit (not illustrated) starts to drive the electric motor M, the displacement mechanism 2 is operated by the electric motor M to displace the platen 5 from the separation position to the adjacent position.

Further, as the control unit starts to drive the electric motor M, the sheet feeding roller 11, the separation roller 12, the conveyance rollers 14A and 14B, the image forming unit 20, and the discharge rollers 19A and 19B are driven. The driven sheet feeding roller 11 comes into contact with the sheet S placed on the platen 5, and the sheet S on the platen 5 is discharged to the conveying path P. The pair of conveyance rollers 14A and 14B convey the sheet S to the process cartridge 21. The sheet feeding device 1 repeatedly displaces the platen 5 to the separation position and the adjacent position to sequentially discharge the sheet S to the conveying path P.

In the process cartridge 21, the surface of the photosensitive drum 22 is uniformly positively charged by the charger 25, and then, is exposed to light by the laser beam irradiated from the scanner 29. In this way, the surface of the photosensitive drum 22 is formed with the electrostatic latent image corresponding to the image to be formed. Further, the developing roller 23 and the toner supply roller 24 supply the toner to the photosensitive drum 22 from the toner accommodating portion 26. Thus, a toner image corresponding to the electrostatic latent image is carried on the surface of the photosensitive drum 22. The toner image is transferred to the sheet S by the rotation of the photosensitive drum 22 while abutting against the sheet S, and the operation of a negative voltage applied to the transfer roller 27.

The sheet S transferred with the toner image is heated by the heating roller 31 in the fixing unit 30, and simultaneously, is pressed against the heating roller 31 by the pressing roller 32. In this way, the toner image is fixed on the sheet S. After that, the sheet S is conveyed to the discharge rollers 19A and 19B, and is discharged toward the discharge tray 72 though the discharge port 71. Thereafter, the printer 3 terminates the process of forming the image on the sheet S.

Effects

In the image forming process performed by the printer 3, the sheet feeding device 1 has the following effects when the sheet feeding roller 11 discharges the sheet S to the conveying path P.

That is, as illustrated in FIGS. 3 and 4, as the platen 5 is swung by the displacement mechanism 2, the sheet S on the platen is moved toward the sheet feeding roller 11, and thus the uppermost sheet S comes into contact with the sheet feeding roller 11. In this way, one or plural sheets S are conveyed by the sheet feeding roller 11 to the downstream side in the sheet conveying direction. Each sheet S is moved while being brought into sliding contact with the separation pad 13, and is nipped between the separation roller 12 and the separation pad 13. The separation roller 12 conveys one or plurality of sheets S in the state in which the sheets S are brought into sliding contact with the separation pad 13, and thereby, conveying resistance is applied to the sheets S. As the plurality of sheets S are brought into sliding contact with the separation pad 13 by the sheet feeding roller 11, the conveying resistance is applied to the sheet S. After that, as the sheets S are nipped between the separation roller 12 and the separation pad 13 and thus the conveying resistance is applied thereto, the sheets are separated one by one.

In this instance, the sheet S conveyed by the sheet feeding roller 11 is brought into contact with the flaps 50 and 51, as illustrated in FIG. 3, and distances L1 and L2 between contact positions T1 and T2, where the sheet abuts against the separation pad 13, and a nip position N are changed according to a basis weight of the sheet.

That is, as indicated by a two-dot chain line, since it is difficult for the sheet S1 having the low basis weight to move the flaps 50 and 51, the sheet is largely bent, so that the distance L1 from the contact position T1 to the nip position N becomes long. For this reason, the conveying resistance is increased when the sheet is brought into sliding contact with the separation pad 13.

As indicated by a solid line, since it is easy for the sheet S2 having the large basis weight to move the flaps 50 and 51, the sheet is not bent so much, so that the distance L2 from the contact position T1 to the nip position N becomes short. For this reason, the conveying resistance is decreased when the sheet is brought into sliding contact with the separation pad 13.

In other words, as illustrated in FIG. 4, since the sheet S is brought into contact with the flaps 50 and 51, a bending angle of the sheet S is changed depending upon its stiffness. As the bending angle of the sheet S is changed, approach angles θ1 and θ2 of the sheet S with respect to the separation pad 13 is changed, and thus, the distances L1 and L2 between the contact positions T1 and T2, where the sheet abuts against the separation pad 13, and the nip position N are changed.

That is, as indicated by the solid line, since it is easy for the sheet S2 having the strong stiffness to move the flaps 50 and 51, the sheet S2 is not bent so much. If the sheet S2 is slightly bent, the distance L2 from the contact position T1 to the nip position N becomes short. For this reason, the conveying resistance is hardly changed. Meanwhile, as indicated by the two-dot chain line, since it is difficult for the sheet S1 having the weak strong stiffness to move the flaps 50 and 51, the sheet S1 is largely bent. If the sheet S1 is largely bent, the distance L1 from the contact position T1 to the nip position N becomes long. For this reason, the conveying resistance is increased when the sheet is brought into sliding contact with the separation pad 13.

In this way, the printer 3 increases the conveying resistance of the sheet S2 having the weak stiffness, thereby bringing it close to the conveying resistance of the sheet S1.

Therefore, it becomes difficult for the double feeding or the non-feeding to occur in the printer 3, irrespective of the type of sheet S. In other words, according to the printer 3, the degree of freedom in selection of sheet is increased.

In particular, according to the printer 3, the flaps 50 and 51 have the width W2 larger than the width W1. For this reason, since the flaps 50 and 51 can bend the sheet S not in a narrow range, but in a wide range, it is possible to reliably change the conveying resistance when the sheet is brought into sliding contact with the separation pad 13. Further, when the sheet S is picked up by the sheet feeding roller 11, the electricity charged on the sheet S can be removed by the flaps 50 and 51, thereby reliably conveying the sheet S. Further, according to the printer 3, since the flaps 50 and 51 are overlapped with the sheet feeding roller 11 by the width W3 in the conveying direction of the sheet S, the flaps 50 and 51 are provided near a position where the sheet S is easily electrostatically charged, thereby easily removing the charge from the sheet S.

Further, according to the printer 3, since the flaps 50 and 51 are provided at both sides, with the separation roller 12 being located between the flaps, the sheet S can be pressed from both sides of the separation roller 12. For this reason, the entire sheet S can be bent, and the conveying resistance is changed when the sheet is brought into sliding contact with the separation pad 13. Therefore, it is possible to suppress the occurrence of the double feeding or the non-feeding according to the difference in the type of sheet S.

In addition, according to the printer 3, since the sheet feeding roller 11 and the separation roller 12 are held by the holder 33, and the flaps 50 and 51 are provided to the sheet feeding frame 15 supporting the holder 33, the flaps 50 and 51 can be easily provided to the sheet feeding device 1.

Further, according to the printer 3, since the flaps 50 and 51 are provided between the sheet feeding roller 11 and the separation roller 12 in the conveying direction of the sheet S, the operation of the flaps can be favorably exhibited.

In addition, according to the printer 3, the flaps 50 and 51 have the torsion coil springs 50A and 51A. For this reason, it is possible to easily prevent the double feeding or the non-feeding from occurring by selection of the torsion coil springs 50A and 51A.

Second Embodiment

The printer of the second embodiment employs a film 52 as the separation assistant member. The film 52 is fixed to the sheet feeding frame 15 at its upper end. The film 52 can be elastically deformed, and is bent against its elastic force by the contact of the sheet S. The film may employ polyethylene, polypropylene, or stainless. Other configurations are substantially identical to those of the first embodiment.

The same effects as those of the first embodiment can be obtained by the printer of the second embodiment. Further, according to the printer of the second embodiment, since the film 52 is simple, it is possible to lower a manufacturing cost.

Test

Paper A, paper B, and paper C were respectively prepared as thin paper, standard paper, and heavy paper. Further, separation pads X and Y having different coefficient of friction were prepared. A necessary conveying force ($N/mm^2$) per conveying amount of 1 mm for the paper A to C on the separation pads X and Y was respectively measured, and its results are shown in Table 1.

TABLE 1

| | Separation pad X ($N/mm^2$) | Separation pad Y ($N/mm^2$) |
|---|---|---|
| Paper A | 0.055 | 0.050 |
| Paper B | 0.175 | 0.100 |
| Paper C | 0.662 | 0.569 |

Further, a necessary conveyance force ratio per conveying amount of 1 mm for the paper A to C on the separation pads X and Y was respectively measured, and its results are shown in Table 2.

TABLE 2

| | Separation pad X | Separation pad Y |
|---|---|---|
| Paper A | 1.0 | 1.0 |
| Paper B | 3.2 | 2.0 |
| Paper C | 12.0 | 11.4 |

In addition, a reaction force ratio according to bending rigidity of the paper A to C on the separation pads X and Y was respectively measured, and its results are shown in Table 3.

TABLE 3

| | Second moment of area | Reaction force (N/mm) | Reaction force ratio |
|---|---|---|---|
| Paper A | 0.000048 | 0.418833978 | 1.0 |
| Paper B | 0.000120 | 1.478969425 | 3.5 |
| Paper C | 0.000608 | 4.472097700 | 10.7 |

In this instance, the second moment of area is calculated by means of Expression 1. Herein, b denotes a width of the paper A to C, and h denotes a thickness of the paper A to C.

$$I = \frac{bh^3}{12} \qquad \text{Expression 1}$$

Figure 7:
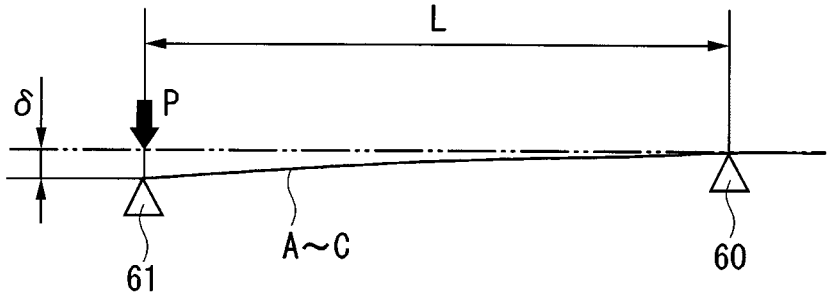
FIG. 7 is a diagram describing a distance from a contact position and a nip position according to the difference in stiffness, in the printer according to the first embodiment.

As illustrated in FIG. 7, it is supposed that each paper A to C is regarded as a cantilever beam in which the paper is held at a supporting point 60, and a bending reaction force P from the separation assistant member acts on an operating point 61 which is located at the distance L from the supporting point 60. In this instance, Expression 2 is established. Herein, δ is a bending amount of a front end of each paper A to C, and E is Young's modulus of each paper A to C.

$$\delta = \frac{PL^3}{3EI} \qquad \text{Expression 2}$$

Supposing that the bending amount δ and the distance L are associated with a condition coefficient α, which is determined at a relative position, irrespective of each paper A to C, if Expressions 1 and 2 are modified, Expression 3 is established. That is, a ratio of bending reaction force P is obtained by 3EI.

$$P = 3EI \cdot \frac{\delta}{L^3} = 3EI \cdot \alpha \qquad \text{Expression 3}$$

Since a reaction force N generated by the stiffness of the sheet S generally meets a relation of F=μN, the conveying resistance F is determined by the coefficient of friction μ, and a linear relationship between the conveying resistance and the coefficient of friction is shown.

Figure 8:
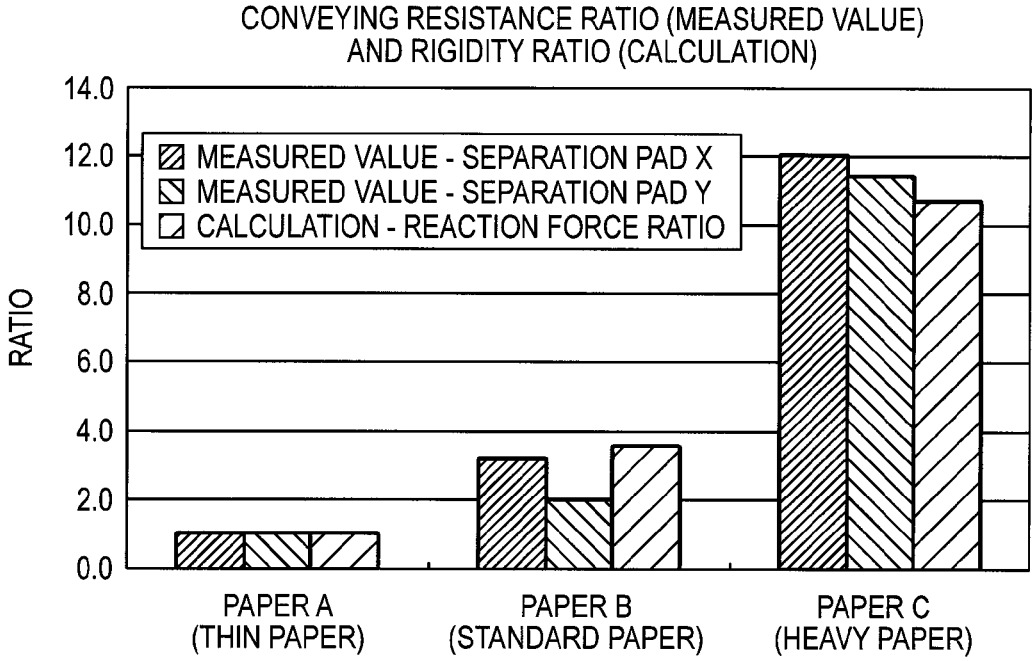
FIG. 8 is a graph illustrating a conveying resistance ratio and a rigidity ratio according to a difference in the type of sheet, in the printer according to the first embodiment.

With respect to each paper A to C, the measured value for the separation pad X, the measured value for the separation pad Y, and the reaction force ratio obtained by calculation are shown in FIG. 8. According to FIG. 8, since the conveying resistance ratio obtained by the measurement can be approximated by the bending rigidity ratio of the sheet S, the conveying resistance is dominantly associated with the stiffness of the sheet S.

Although the conveying force which can endure the conveying resistance is generally secured by the pressing force of the sheet feeding roller 11, the excessive pressing force may cause the occurrence of the double feeding. Therefore, in general, the pressing force more than necessary is not set. For this reason, the sheet feeding device of a frictional separation type had a problem in that the stiffness of the sheet S capable of being conveyed is limited to some extent. However, according to the present invention, it will be understood that the conveying resistance of the sheet S can be corrected within predetermined ranges, irrespective of the stiffness of the sheet S itself.

Heretofore, although the present invention has been described with reference to the first and second embodiments, the present invention is not limited thereto, and can be appropriately modified and applied, without being deviated from the gist of the present invention.

For example, the present invention can be applied to a printer including a detachable sheet feeding tray. In this instance, the sheet feeding tray may be a manual tray which is mounted to the main body, in addition to a main body on which the sheets S are placed, and a cartridge which can be attached to or detached from the main body with the sheets S being placed on the cartridge. The placing portion may be a platen provided to a main body or a cartridge, or an upper surface of an input tray.

As the moving unit, various units can be employed as long as the sheet placed on the placing portion is moved toward the sheet feeding roller.

It is possible to detect the feeding of the sheet S by the swing of the flaps 50 and 51.

The present invention can be used for an image forming apparatus or a multifunction machine.

The present invention provides illustrative, non-limiting examples as follows:

(1) In a first aspect, there is provided a sheet feeding device including: a sheet feeding roller configured to come into contact with a sheet and convey the sheet; a placing portion configured to swing toward the sheet feeding roller and on which the sheet is configured to be placed; a moving unit configured to move the placing portion toward the sheet feeding roller; a separation pad to which a leading end of the sheet conveyed by the sheet feeding roller is configured to abut at a contact position; a separation roller disposed at a downstream side than the sheet feeding roller in a sheet conveying direction and configured to nip the sheet conveyed by the sheet feeding roller between the separation pad and the separation roller at a nip position while bringing the sheet into sliding contact with the separation pad; and a separation assistant member provided between the sheet feeding roller and the separation roller and configured to change a distance between the nip position and the contact position according to a basis weight of the sheet conveyed by the sheet feeding roller by coming into contact with the sheet.

According to the first aspect, since the sheet conveyed by the sheet feeding roller is brought into contact with the separation assistant member, the distance between the contact position, where a leading end of the sheet abuts against the separation pad, and the nip position is changed according to the basis weight of the sheet. In other words, since the sheet comes into contact with the separation assistant member, a bending angle of the sheet is changed depending on its stiffness. As the bending angle of the sheet is changed, an approach angle of the sheet with respect to the separation pad is changed, and thus, the distance between the contact position, where the leading end of the sheet abuts against the separation pad, and the nip position is changed. If the distance of the sliding contact region on the separation pad is changed, a conveying resistance when the sheet is brought into sliding contact with the separation pad is changed, according to the difference between the approach angle of the sheet and the angle of the separation pad and the stiffness of the sheet.

The conveying resistance of the sheet having the strong stiffness is hardly changed. Meanwhile, since it is difficult for the sheet having the weak stiffness to move the separation assistant member, the sheet is largely bent. If the sheet is largely bent, the distance between the contact position and the nip position becomes long, and thus, the conveying resistance is increased when the sheet is brought into sliding contact with the separation pad.

In this way, the sheet feeding device increases the conveying resistance of the sheet having the weak stiffness, thereby bringing it close to the conveying resistance of the sheet having the strong stiffness.

Accordingly, it is difficult for the double feeding or the non-feeding to occur in the sheet feeding device of the present invention, irrespective of the type of sheet. In other words, according to the sheet feeding device of the present invention, the degree of freedom in selection of sheet is increased.

(2) In a second aspect, there is provided the sheet feeding device according to the first aspect, wherein a width of the separation assistant member is larger than a width of a contact region between the separation roller and the separation pad in a width direction of the sheet.

Accordingly, since the separation assistant member can bend the sheet not in a narrow range, but in a wide range, it is possible to reliably change the conveying resistance when the sheet is brought into sliding contact with the separation pad.

(3) In a third aspect, there is provided the sheet feeding device according to the first or second aspect, wherein a width of the separation assistant member is larger than a width of the sheet feeding roller in the width direction of the sheet.

When the sheet is picked up by the sheet feeding roller, the sheet may be electrostatically charged, so that an adhesion force is generated between the sheets to increase the conveying resistance. However, if the separation assistant member has a width wider than the sheet feeding roller, the electricity charged on the sheet can be removed by the separation assistant member, thereby reliably conveying the sheet.

(4) In a fourth aspect, there is provided the sheet feeding device according to any one of the first to third aspects, wherein the separation assistant member is respectively provided at both sides of the separation roller in the width direction of the sheet with the separation roller being located between the separation assistant members.

Accordingly, since the sheet is pressed from both sides of the separation roller, the entire sheet can be bent, and the conveying resistance is changed when the sheet is brought into sliding contact with the separation pad. Therefore, it is possible to suppress the occurrence of the double feeding or the non-feeding according to the difference in the type of sheet.

(5) In a fifth aspect, there is provided the sheet feeding device according to any one of the first to fourth aspects, wherein the paper feed roller and the separation roller are held by one holder which is configured to swing with respect to the sheet, and wherein the separation assistant member is provided to a frame which is configured to support the holder.

Accordingly, the separation assistant member can be easily provided to the sheet feeding device.

(6) In a sixth aspect, there is provided the sheet feeding device according to any one of the first to fifth aspects, wherein the separation assistant member is provided between the sheet feeding roller and the separation roller in the sheet conveying direction.

Accordingly, the separation assistant member favorably exhibits its operation.

(7) In a seventh aspect, there is provided the sheet feeding device according to any one of the first to sixth aspects, wherein the separation assistant member includes a flap including a biasing member configured to exert a preset biasing force and swing against the biasing force by contacting with the sheet.

Accordingly, it is possible to easily prevent the double feeding or the non-feeding by selection of the biasing member.

(8) In an eighth aspect, there is provided the sheet feeding device according to any one of the first to sixth aspects, wherein the separation assistant member includes a film configured to elastically deform and bend against the elastic force by contacting with the sheet.

Accordingly, the separation assistant member can be simplified, and thus it is possible to lower a manufacturing cost of the sheet feeding device.

(9) In a ninth aspect, there is provided a sheet feeding device including: a sheet feeding roller configured to come into contact with a sheet and convey the sheet; a placing portion configured to swing toward the sheet feeding roller and on which the sheet is configured to be placed; a moving unit configured to move the placing portion toward the sheet feeding roller; a separation pad to which a leading end of the sheet conveyed by the sheet feeding roller is configured to abut at a contact position; a separation roller disposed at a downstream side than the sheet feeding roller in a sheet conveying direction and configured to nip the sheet conveyed by the sheet feeding roller between the separation pad and the separation roller at a nip position while bringing the sheet into sliding contact with the separation pad; and a separation assistant member provided between the sheet feeding roller and the separation roller and configured to be swung or elastically deformed toward the separation roller by coming into contact with the sheet conveyed by the sheet feeding roller.

Accordingly, it is difficult for the double feeding or the non-feeding to occur, irrespective of the type of sheet. In other words, according to the sheet feeding device, the degree of freedom in selection of the sheet is increased.

What is claimed is:

1. A sheet feeding device comprising:

a sheet feeding roller configured to come into contact with a sheet and convey the sheet;

a placing portion configured to swing toward the sheet feeding roller and on which the sheet is configured to be placed;

a moving unit configured to move the placing portion toward the sheet feeding roller;

a separation pad to which a leading end of the sheet conveyed by the sheet feeding roller is configured to abut at a contact position;

a separation roller disposed at a downstream side than the sheet feeding roller in a sheet conveying direction and configured to nip the sheet conveyed by the sheet feeding roller between the separation pad and the separation roller at a nip position while bringing the sheet into sliding contact with the separation pad; and a separation assistant member provided between the sheet feeding roller and the separation roller and configured to change a distance between the nip position and the contact position according to a basis weight of the sheet conveyed by the sheet feeding roller by coming into contact with the sheet;

wherein a width of the separation assistant member is larger than a width of a contact region between the separation roller and the separation pad in a width direction of the sheet.

2. The sheet feeding device according to claim 1, wherein a width of the separation assistant member is larger than a width of the sheet feeding roller in the width direction of the sheet.

3. The sheet feeding device according to claim 1, wherein the separation assistant member is respectively provided at both sides of the separation roller in the width direction of the sheet with the separation roller being located between the separation assistant members.

4. The sheet feeding device according to claim 1, wherein the paper feed roller and the separation roller are held by one holder which is configured to swing with respect to the sheet, and wherein the separation assistant member is provided to a frame which is configured to support the holder.

5. The sheet feeding device according to claim 1, wherein the separation assistant member is provided between the sheet feeding roller and the separation roller in the sheet conveying direction.

6. The sheet feeding device according to claim 1, wherein the separation assistant member includes a flap including a biasing member configured to exert a preset biasing force and swing against the biasing force by contacting with the sheet.

7. The sheet feeding device according to claim 1, wherein the separation assistant member includes a film configured to elastically deform and bend against the elastic force by contacting with the sheet.

8. A sheet feeding device comprising:

a sheet feeding roller configured to come into contact with a sheet and convey the sheet;

a placing portion configured to swing toward the sheet feeding roller and on which the sheet is configured to be placed;

a moving unit configured to move the placing portion toward the sheet feeding roller;

a separation pad to which a leading end of the sheet conveyed by the sheet feeding roller is configured to abut at a contact position;

a separation roller disposed at a downstream side than the sheet feeding roller in a sheet conveying direction and configured to nip the sheet conveyed by the sheet feeding roller between the separation pad and the separation roller at a nip position while bringing the sheet into sliding contact with the separation pad; and a separation assistant member provided between the sheet feeding roller and the separation roller and configured to be swung or elastically deformed toward the separation roller by coming into contact with the sheet conveyed by the sheet feeding roller;

wherein the separation assistant member is respectively provided at both sides of the separation roller in the width direction of the sheet with the separation roller being located between the separation assistant members.

9. The sheet feeding device according to claim 8, wherein a width of the separation assistant member is larger than a width of a contact region between the separation roller and the separation pad in a width direction of the sheet.

10. The sheet feeding device according to claim 8, wherein a width of the separation assistant member is larger than a width of the sheet feeding roller in the width direction of the sheet.

11. The sheet feeding device according to claim 8, wherein the paper feed roller and the separation roller are held by one holder which is configured to swing with respect to the sheet, and wherein the separation assistant member is provided to a frame which is configured to support the holder.

12. The sheet feeding device according to claim 8, wherein the separation assistant member is provided between the sheet feeding roller and the separation roller in the sheet conveying direction.

13. The sheet feeding device according to claim 8, wherein the separation assistant member includes a flap including a biasing member configured to exert a preset biasing force and swing against the biasing force by contacting with the sheet.

14. The sheet feeding device according to claim 8, wherein the separation assistant member includes a film configured to elastically deform and bend against the elastic force by contacting with the sheet.

15. A sheet feeding device comprising:

a sheet feeding roller configured to come into contact with a sheet and convey the sheet;

a placing portion configured to swing toward the sheet feeding roller and on which the sheet is configured to be placed;

a moving unit configured to move the placing portion toward the sheet feeding roller;

a separation pad to which a leading end of the sheet conveyed by the sheet feeding roller is configured to abut at a contact position;

a separation roller disposed at a downstream side than the sheet feeding roller in a sheet conveying direction and configured to nip the sheet conveyed by the sheet feeding roller between the separation pad and the separation roller at a nip position while bringing the sheet into sliding contact with the separation pad; and a separation assistant member provided between the sheet feeding roller and the separation roller and configured to change a distance between the nip position and the contact position according to a basis weight of the sheet conveyed by the sheet feeding roller by coming into contact with the sheet;

wherein the separation assistant member is respectively provided at both sides of the separation roller in the width direction of the sheet with the separation roller being located between the separation assistant members.

16. The sheet feeding device according to claim 15, wherein a width of the separation assistant member is larger than a width of the sheet feeding roller in the width direction of the sheet.

17. The sheet feeding device according to claim 15, wherein the paper feed roller and the separation roller are held by one holder which is configured to swing with respect to the sheet, and wherein the separation assistant member is provided to a frame which is configured to support the holder.

18. The sheet feeding device according to claim 15, wherein the separation assistant member is provided between the sheet feeding roller and the separation roller in the sheet conveying direction.

19. The sheet feeding device according to claim 15, wherein the separation assistant member includes a flap including a biasing member configured to exert a preset biasing force and swing against the biasing force by contacting with the sheet.

20. The sheet feeding device according to claim 15, wherein the separation assistant member includes a film configured to elastically deform and bend against the elastic force by contacting with the sheet.

* * * * *